US011605892B2

(12) United States Patent
Lim et al.

(10) Patent No.: US 11,605,892 B2
(45) Date of Patent: Mar. 14, 2023

(54) ANTENNA DEVICE

(71) Applicant: Samsung Electro-Mehanics Co., Ltd., Suwon-si (KR)

(72) Inventors: Daeki Lim, Suwon-si (KR); Youngsik Hur, Suwon-si (KR); Juhyoung Park, Suwon-si (KR); Jeongki Ryoo, Suwon-si (KR); Myeong Woo Han, Suwon-si (KR); Woncheol Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 89 days.

(21) Appl. No.: 17/146,560

(22) Filed: Jan. 12, 2021

(65) Prior Publication Data

US 2022/0085506 A1 Mar. 17, 2022

(30) Foreign Application Priority Data

Sep. 16, 2020 (KR) ..... 10-2020-0119014

(51) Int. Cl.
*H01Q 1/48* (2006.01)
*H01Q 9/04* (2006.01)
*H01Q 5/307* (2015.01)

(52) U.S. Cl.
CPC ..... *H01Q 9/045* (2013.01); *H01Q 1/48* (2013.01); *H01Q 5/307* (2015.01); *H01Q 9/0414* (2013.01)

(58) Field of Classification Search
CPC ..... H01Q 9/045; H01Q 1/48; H01Q 5/307; H01Q 9/0414
See application file for complete search history.

(56) References Cited

U.S. PATENT DOCUMENTS

| | | | | |
|---|---|---|---|---|
| 6,914,565 | B2 | 7/2005 | Shikata et al. | |
| 2019/0319364 | A1* | 10/2019 | Yang | H01Q 5/385 |
| 2020/0127387 | A1 | 4/2020 | Park et al. | |
| 2020/0136269 | A1 | 4/2020 | Choi et al. | |
| 2020/0403322 | A1* | 12/2020 | Ryu | H01Q 21/08 |

FOREIGN PATENT DOCUMENTS

| | | | | |
|---|---|---|---|---|
| JP | 2004-228692 | A | | 8/2004 |
| JP | 2005124056 | A | * | 5/2005 |
| KR | 10-2020-0045726 | A | | 5/2020 |
| KR | 10-2020-0046482 | A | | 5/2020 |

* cited by examiner

*Primary Examiner* — Dieu Hien T Duong
(74) *Attorney, Agent, or Firm* — NSIP Law

(57) ABSTRACT

An antenna device includes: a dielectric layer including a first edge extending in a first direction and a second edge, shorter that the first edge, extending in a second direction; a first feed via penetrating a portion of the dielectric layer in a third direction, and disposed adjacent to the second edge; a second feed via penetrating a portion of the dielectric layer in the third direction, disposed adjacent to the first edge; a feed pattern connected to the second feed via; and an antenna patch disposed on the second feed via and the feed pattern in the third direction, and coupled to the first feed via, the second feed via, and the feed pattern. The antenna patch overlaps the first feed via in a direction parallel to the first direction or the second direction. The antenna patch overlaps the feed pattern in a direction parallel to the third direction.

20 Claims, 15 Drawing Sheets

ANTENNA DEVICE

CROSS-REFERENCE TO RELATED APPLICATION(S)

This application claims the benefit under 35 USC § 119(a) of Korean Patent Application No. 10-2020-0119014, filed on Sep. 16, 2020, in the Korean Intellectual Property Office, the entire disclosure of which is incorporated herein by reference for all purposes.

BACKGROUND

1. Field

The following description relates to an antenna device.

2. Description of Related Art

Recently, millimeter wave (mmWave) communication, including 5th generation (5G) communication, has been actively implemented.

Additionally, as portable electronic devices are developed, the size of a screen in a display area of the electronic device has increased, the size of a bezel that is a non-display area in which an antenna is disposed is reduced, and the area of the region in which the antenna may be installed is also reduced.

The above information disclosed in this Background section is only for enhancement of understanding of the background of the described technology, and therefore it may contain information that does not form the prior art that is already known in this country to a person of ordinary skill in the art.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, an antenna device includes a dielectric layer, comprising a first edge that extends in a first direction and a second edge that extends in a second direction; a first feed via, configured to penetrate through at least a portion of the dielectric layer in a third direction, and disposed to be adjacent to the second edge; a second feed via, configured to penetrate through at least a portion of the dielectric layer in the third direction, and disposed to be adjacent to the first edge; a feed pattern, connected to the second feed via; and an antenna patch, disposed on the second feed via and the feed pattern in the third direction, and coupled with the first feed via, the second feed via, and the feed pattern, wherein the first edge is longer than the second edge, and wherein the antenna patch overlaps the first feed via in a direction parallel to the first direction or the second direction, and the antenna patch overlaps the feed pattern in a direction parallel to the third direction.

The antenna may include a ground plane disposed below the dielectric layer in the third direction, wherein a height of the first feed via is greater than a height of the second feed via and a height of the feed pattern with respect to the ground plane in the third direction.

The antenna patch may be configured to have at least one hole, and the first feed via overlaps the antenna patch in the direction parallel to the first direction or the second direction in the at least one hole.

The feed pattern may include a first portion connected to the second feed via and extending in a direction parallel to the first direction, and a second portion that extends from the first portion in a direction parallel to the second direction.

The antenna device may be configured to transmit and receive a horizontal polarization signal based on an electrical signal applied to the first feed via, and may be configured to transmit and receive a vertical polarization signal based on an electrical signal applied to the second feed via.

The antenna patch may include a first antenna patch and a second antenna patch sequentially disposed in the third direction, and a surface area of the second antenna patch is greater than a surface area of the first antenna patch.

The dielectric layer may include a first layer, a second layer, a third layer, and a fourth layer sequentially disposed in the third direction, the first feed via penetrates through the first layer and the second layer, and the second feed via penetrates through the first layer, and the feed pattern is disposed on the first layer.

The first antenna patch may be disposed on the second layer, the third layer may be disposed between the first antenna patch and the second antenna patch, a dielectric constant of the third layer may be smaller than a dielectric constant of the first layer and a dielectric constant of the second layer, and the third layer may include an air cavity.

In a general aspect, an antenna includes a first dielectric layer and a second dielectric layer spaced apart from each other in a first direction; a first antenna patch, disposed on the first dielectric layer in a third direction; a second antenna patch, disposed on the second dielectric layer in the third direction; a first feed via and a second feed via coupled to the first antenna patch; a feed pattern, coupled to the first antenna patch, and extended from the second feed via; and a third feed via and a fourth feed via coupled to the second antenna patch, wherein the antenna device is configured to transmit and receive a signal with a first frequency bandwidth based on an electrical signal applied to the first antenna patch, and wherein the antenna device is configured to transmit and receive a signal with a second frequency bandwidth different from the first frequency bandwidth based on an electrical signal applied to the second antenna patch.

The first dielectric layer may include a first edge that extends in the first direction and a second edge that extends in the second direction, the second dielectric layer may include a third edge that extends in the first direction and a fourth edge that extends in the second direction, and the first edge may be longer than the second edge.

A center frequency of the first frequency bandwidth may be lower than a center frequency of the second frequency bandwidth.

The second feed via may be disposed to be adjacent to the first edge, and the fourth feed via may be disposed to be adjacent to the third edge.

The first feed via may be disposed to be adjacent to the second edge, the first antenna patch may include at least one hole, and the first feed via may overlap the first antenna patch in a direction parallel to the first direction or the second direction in the at least one hole.

The feed pattern may include a first portion connected to the second feed via and extending in a direction parallel to the first direction, and a second portion that extends from the first portion in a direction parallel to the second direction.

The antenna device may be configured to transmit and receive a horizontal polarization signal based on an electrical signal applied to the first feed via, and may be configured to transmit and receive a vertical polarization signal based on an electrical signal applied to the second feed via.

In a general aspect, an antenna device includes a first dielectric layer and a second dielectric layer spaced apart from each other in a first direction; a first antenna patch, disposed on the first dielectric layer in a third direction; a second antenna patch, disposed on the second dielectric layer in the third direction; a first feed via and a second feed via coupled to the first antenna patch; and a third feed via and a fourth feed via coupled to the second antenna patch, wherein the antenna device is configured to transmit and receive a signal with a first frequency bandwidth based on an electrical signal applied to the first antenna patch, wherein the antenna device is configured to transmit and receive a signal with a second frequency bandwidth that is different from the first frequency bandwidth based on an electrical signal applied to the second antenna patch, wherein the first antenna patch is fed from the first feed via by a first feeding method, and is fed from the second feed via by a second feeding method that is different from the first feeding method, and wherein the second antenna patch is fed from the third feed via by a third feeding method, and is fed from the fourth feed via by the third feeding method.

A center frequency of the first frequency bandwidth may be lower than a center frequency of the second frequency bandwidth.

The first feeding method may be a capacitively coupled feeding method, and the second feeding method is an L-probe coupled feeding method.

The first dielectric layer may include a first edge that extends in the first direction, and a second edge that extends in a second direction, the second dielectric layer may include a third edge that extends in the first direction, and a fourth edge that extends in the second direction, and the first edge may be longer than the second edge.

The first feed via may be disposed to be adjacent to the second edge, the second feed via may be disposed to be adjacent to the first edge, the third feed via may be disposed to be adjacent to the fourth edge, the fourth feed via may be disposed to be adjacent to the third edge, the first antenna patch may include at least one hole, and the first feed via may overlap the first antenna patch in a direction parallel to the first direction or the second direction in the at least one hole, and the antenna device may further include a feed pattern comprising a first portion connected to the second feed via, and extending in a direction parallel to the first direction, and a second portion extending from the first portion in a direction parallel to the second direction.

Other features and aspects will be apparent from the following detailed description, the drawings, and the claims.

Figure 1:
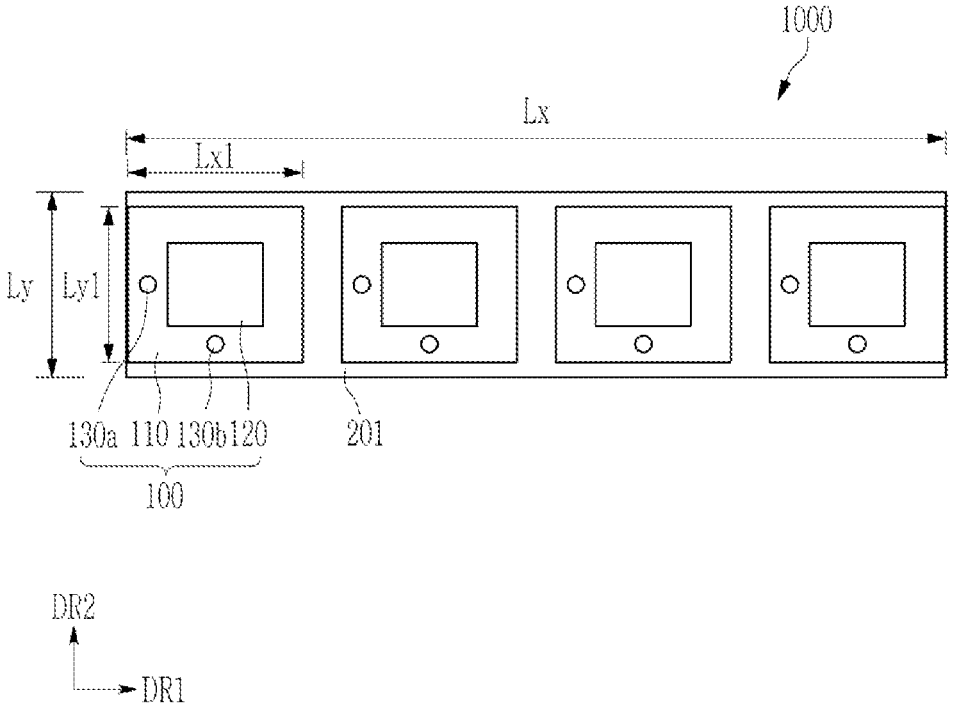
FIG. 1 illustrates a top plan view of an example antenna device, in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known after an understanding of the disclosure of this application may be omitted for increased clarity and conciseness, noting that omissions of features and their descriptions are also not intended to be admissions of their general knowledge.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Throughout the specification, when an element, such as a layer, region, or substrate is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains and after an understanding of the disclosure of this application. Terms, such as those defined in commonly used dictionaries, are to be interpreted as having a meaning that is consistent with their meaning in the context of the relevant art and the disclosure of this application, and are not to be interpreted in an idealized or overly formal sense unless expressly so defined herein.

The phrase "in a plan view" means viewing an object portion from the top, and the phrase "in a cross-sectional view" means viewing a cross-section of which the object portion is vertically cut from the side.

Throughout the specification, when it is described that a part is "connected" to another part, the part may be "directly connected" to the other element, may be "connected" to the other part through a third part, or may be connected to the other part physically or electrically, and they may be referred to by different titles depending on positions or functions, but respective portions that are substantially integrated into one body may be connected to each other.

Figure 2:
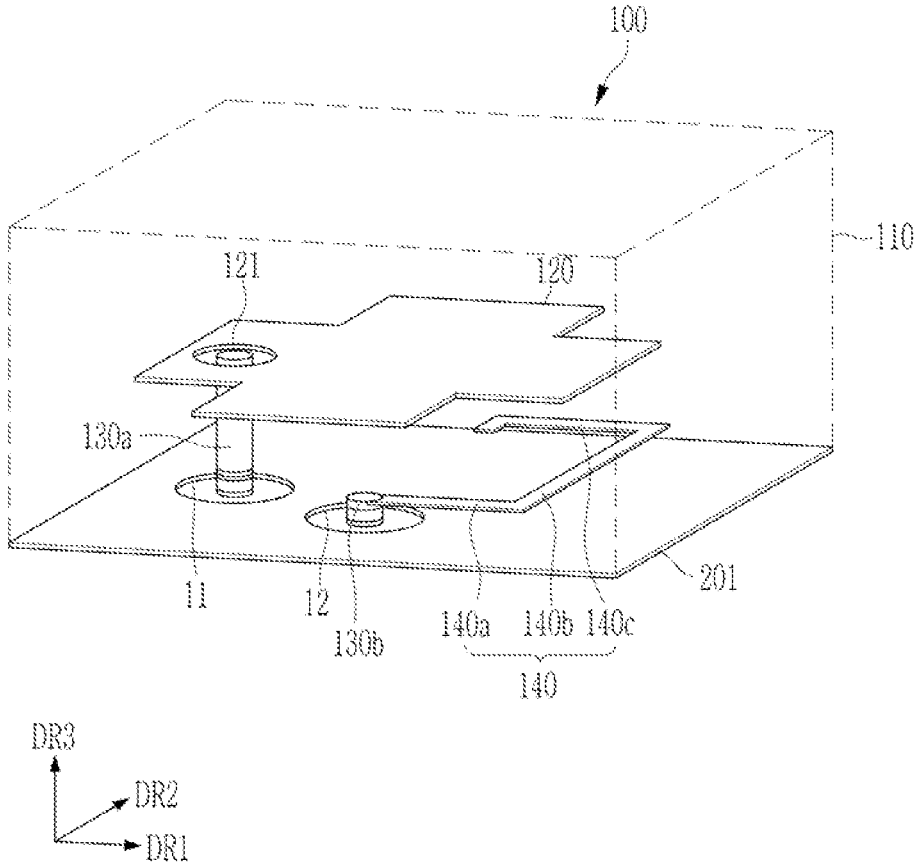
FIG. 2 illustrates a perspective view of part of an example antenna device of FIG. 1.

An example antenna device 1000, in accordance with one or more embodiments, will now be described with reference to FIG. 1 and FIG. 2. FIG. 1 illustrates a top plan view of an example antenna device, in accordance with one or more embodiments, and FIG. 2 shows a perspective view of part of the example antenna device of FIG. 1.

Referring to FIG. 1, the example antenna device 1000 may include a plurality of antennae 100 disposed in series in a first direction DR1.

Each antenna 100 includes a dielectric layer 110 disposed on a ground plane 201, and an antenna patch 120 overlapping the dielectric layer 110. The antenna 100 includes a first feed via 130*a* and a second feed via 130*b* to transmit an electrical signal to the antenna patch 120.

The antenna device 1000 may have a first length (Lx) in a direction parallel to the first direction DR1, and may have a second length (Ly) in a direction parallel to the second direction DR2 that is perpendicular to the first direction DR1, and, in an example, the first length (Lx) may be greater than the second length (Ly).

The dielectric layer 110 of the antenna 100 included in the antenna device 1000 may include a first edge that is parallel to the first direction DR1 and a second edge that is parallel to the second direction DR2, the first edge that is parallel to the first direction DR1 may have a third length Lx1, and a second edge that is parallel to the second direction DR2 may have a fourth length Ly1. The fourth length Ly1 of the dielectric layer 110 of the antenna 100 may be less than the third length Lx1.

The antenna device 1000 is mounted on the electronic device, and as a size of the bezel of the electronic device is reduced, the antenna device 1000 may be mounted on a lateral side of the bezel, instead of a front side of the electronic device. As a thickness of the electronic device is reduced, the thickness of the lateral side of the bezel on which the antenna device 1000 is mounted may also be reduced, and the second length (Ly) of the antenna device 1000 may accordingly be reduced. Further, the fourth length Ly1 of the antenna 100 included in the antenna device 1000 may be reduced.

The antenna device 1000 may include a plurality of antennae 100 disposed in series in the first direction DR1. Accordingly, the size of the antenna device 1000 may be reduced compared to the number of antennae 100 included in the antenna device 1000, and performance of the antenna compared to the size of the antenna device 1000 may be improved.

Additionally, the antenna 100 included in the antenna device 1000 may transmit and receive an RF signal with first polarization based on an electrical signal applied by the first feed via 130*a*, and may transmit and receive the RF signal with second polarization based on the electrical signal applied by the second feed via 130*b*. The first feed via 130*a* may be disposed to be adjacent to an edge that is parallel to the second direction DR2 from among the edges of the dielectric layer 110 of the antenna 100, and the second feed via 130*b* may be disposed to be adjacent to the edge that is parallel to the first direction DR1 from among the edges of the dielectric layer 110 of the antenna 100.

In an example, the RF signal with the first polarization may have horizontal polarization, and the RF signal with the second polarization may have vertical polarization.

Referring to FIG. 2, the first feed via 130*a* and the second feed via 130*b* may pass through a first through-hole 11 and a second through-hole 12 of the ground plane 201, extend to a bottom side of the ground plane 201, and may receive an electrical signal from an electronic element disposed on the bottom side of the ground plane 201. The first feed via 130*a* passes through the dielectric layer 110 in the third direction DR3, an upper side of the first feed via 130*a* may be inserted into a hole 121 formed in the antenna patch 120, and the second feed via 130*b* may be disposed below the antenna patch 120 with respect to the third direction DR3. The second feed via 130*b* may apply an electrical signal to a feed pattern 140 extended from the second feed via 130*b*.

The antenna patch 120 is spaced apart from the first feed via 130*a* and a lateral side of an edge of the hole 121 of the antenna patch 120 to be coupled with the first feed via 130*a*, and thereby receive an electrical signal of the first feed via 130*a*. The method for being spaced apart from the first feed via 130*a*, coupling, and performing feeding will be referred to as a capacitively coupled feed method.

Additionally, the antenna patch 120 overlaps the feed pattern 140 extending from the second feed via 130*b* in the third direction DR3 from top to bottom to be coupled with the second feed via 130*b* and the feed pattern 140, and thereby receive an electrical signal of the second feed via 130*b*. A method for performing feeding with the feed pattern 140 will be referred to as an L-probe coupled feed method.

The electrical signal transmitted through the first feed via 130*a* is transmitted to the antenna patch 120 with the edge of the hole 121 of the antenna patch 120 as a path.

The electrical signal transmitted through the second feed via 130*b* may provide desired impedance to the patch antenna pattern 120 according to a form of the feed pattern 140 overlapping the antenna patch 120, and may provide an additional resonance frequency corresponding to inductance according to a length and a form of the feed pattern 140, thereby having a wider bandwidth. For example, the feed pattern 140 may be connected to the second feed via 130*b*, and may include a first portion 140*a* extending in parallel with the first direction DR1, a second portion 140*b* extending in parallel with the second direction DR2 from the first portion 140*a*, and a third portion 140*c* extending in parallel with the first portion 140*a* in the direction parallel to the first direction DR1 from the second portion 140*b*, so a range of the additional resonance frequency may be controlled by controlling the length of the first portion 140*a*, the length of the second portion 140*b*, and the length of the third portion 140*c*.

As described above, as the electronic device on which the antenna device 1000 is mounted is implemented in a thin form factor, the fourth length Ly1 of the antenna 100 included in the antenna device 1000 may be reduced. To that extent, the fourth length Ly1 of the antenna 100 in parallel with the direction in which the RF signal with second polarization of the antenna 100 is propagated may be reduced, and the bandwidth of the RF signal with second polarization of the antenna 100 may be reduced.

However, according to the example antenna device 1000, the antenna device 1000 is received with the electrical signal for transmitting and receiving the RF signal with first polarization through the first feed via 130*a* inserted in the hole 121 of the antenna patch 120 and coupled with the antenna patch 120, and the antenna device 1000 is received with the electrical signal for transmitting and receiving the RF signal with second polarization through the second feed via 130*b* and the feed pattern 140 disposed below the antenna patch 120 and overlapping the antenna patch 120 to be coupled with the antenna patch 120. Therefore, the electrical signal for transmitting and receiving the RF signal with second polarization of the antenna 100 of which the dielectric layer 110 is propagated in a direction with a relatively short fourth length Ly1 may be transmitted by the feed pattern 140 connected to the second feed via 130*b*, and the antenna 100 may receive an additional resonance frequency corresponding to the inductance of the feed pattern 140 overlapping the antenna patch 120, thereby preventing the bandwidth of the RF signal with second polarization from being reduced. Further, the second feed via 130*b* and the feed pattern 140 are lower than the first feed via 130*a*, and by this, the isolation degree among the first feed via 130*a*, the second feed via 130*b*, and the feed pattern 140 may increase.

Figure 3:
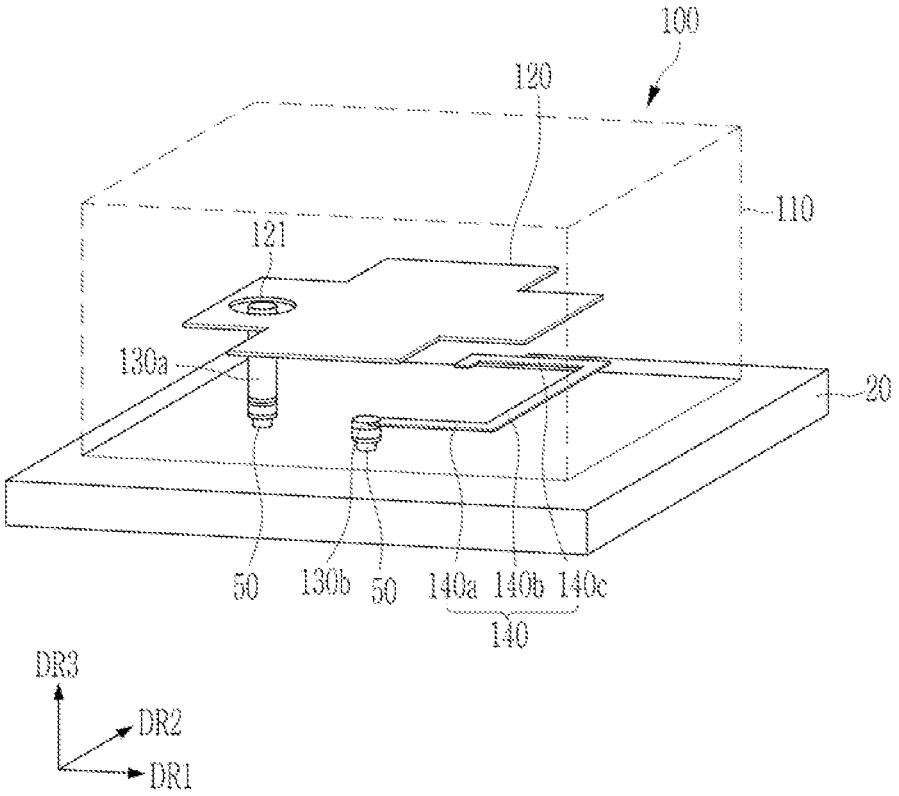
FIG. 3 illustrates a perspective view of part of an example antenna device of FIG. 1.

Another embodiment of a configuration of an example antenna 100 of an antenna device, in accordance with one or more embodiments, will now be described with reference to FIG. 1, FIG. 3, and FIG. 4. FIG. 3 illustrates a perspective view of part of an example antenna device of FIG. 1, and FIG. 4 shows a cross-sectional view of an antenna device shown in FIG. 3.

Figure 4:
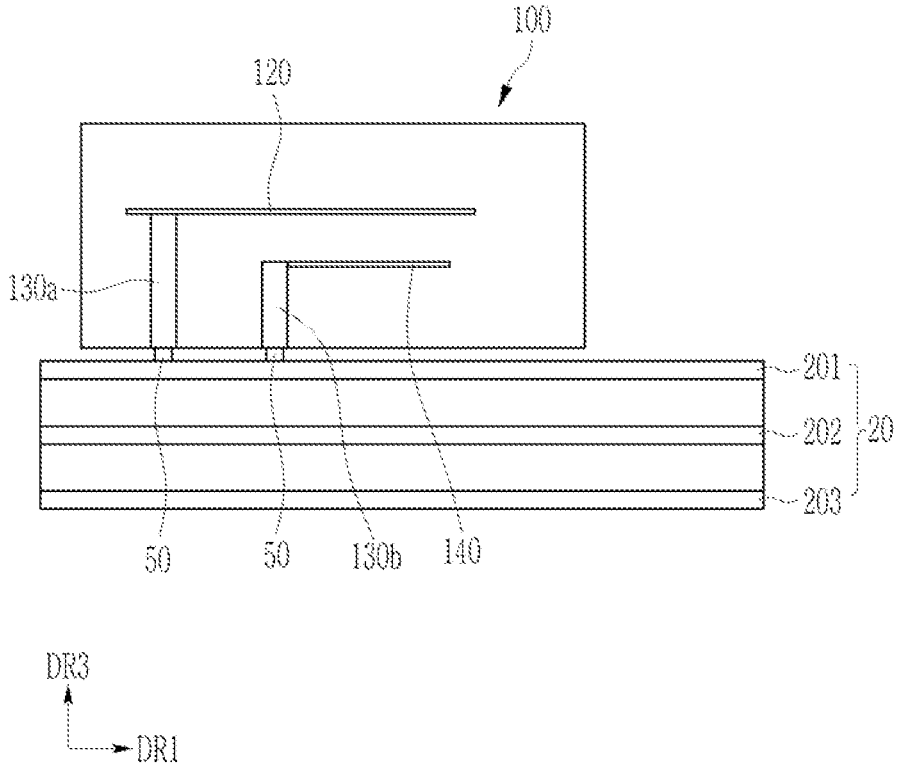
FIG. 4 illustrates a cross-sectional view of an example antenna device shown in FIG. 3.

Referring to FIG. 3 and FIG. 4, the antenna 100, in accordance with one or more embodiments, is similar to the antenna 100 according to an example described with reference to FIG. 1 and FIG. 2. No detailed descriptions of the same constituent elements will be provided.

The antenna 100 includes a dielectric layer 110, an antenna patch 120, a first feed via 130*a*, and a second feed via 130*b*. A connection substrate 20 including a ground plane 201 and a plurality of metal layers 202 and 203 may be disposed below the antenna 100, and the antenna 100 may be connected to the connection substrate 20 through a connector 50. The connector 50 may have a configuration of a solder ball, a pin, a land, or a pad. Although not shown, an electronic element (not shown) may be disposed below the connection substrate 20, and the first feed via 130*a* and the second feed via 130*b* may receive an electrical signal from the electronic element disposed below the connection substrate 20.

The first feed via 130*a* penetrates through the dielectric layer 110 in the third direction DR3 so an upper side of the first feed via 130*a* may be inserted into the hole 121 disposed in the antenna patch 120, and the second feed via 130*b* may be disposed below the antenna patch 120 with respect to the third direction DR3. The second feed via 130*b* may apply an electrical signal to the feed pattern 140 extended from the second feed via 130*b*.

The antenna patch 120 is spaced apart from the first feed via 130*a* and the lateral side of the edge of the hole 121 of the antenna patch 120 to be coupled with the first feed via 130*a*, so it may be fed from the first feed via 130*a* by the capacitively coupled feed method.

Further, the antenna patch 120 overlaps the feed pattern 140 extended from the second feed via 130*b* in the third direction DR3 to be coupled with the second feed via 130*b* and the feed pattern 140, so it may be fed from the second feed via 130*b* according to the L-probe coupled feed method.

As described with reference to FIG. 1, the dielectric layer 110 of the antenna 100 includes a first edge in parallel with the first direction DR1 and a second edge in parallel with the second direction DR2, the first edge in parallel with the first direction DR1 may have a third length Lx1, and the second edge in parallel with the second direction DR2 may have a fourth length Ly1. The fourth length Ly1 of the dielectric layer 110 of the antenna 100 may be less than the third length Lx1.

According to the example antenna 100 of the example antenna device 1000 according to an embodiment, the antenna device 1000 receives the electrical signal for transmitting and receiving the RF signal with first polarization through the first feed via 130*a* inserted in the hole 121 of the antenna patch 120 and coupled with the antenna patch 120, and the antenna device 1000 receives the electrical signal for transmitting and receiving the RF signal with second polarization through the second feed via 130*b* and the feed pattern 140 disposed below the antenna patch 120 and overlapping the antenna patch 120 to be coupled with the antenna patch 120. Therefore, the electrical signal to transmit and receive the RF signal with second polarization of the antenna 100 of which the dielectric layer 110 is propagated in a direction with a relatively short fourth length Ly1 may be transmitted by the feed pattern 140 connected to the second feed via 130*b*, and the antenna 100 may receive an additional resonance frequency corresponding to the inductance of the feed pattern 140 overlapping the antenna patch 120, thereby preventing the bandwidth of the RF signal with second polarization from being reduced.

Figure 5:
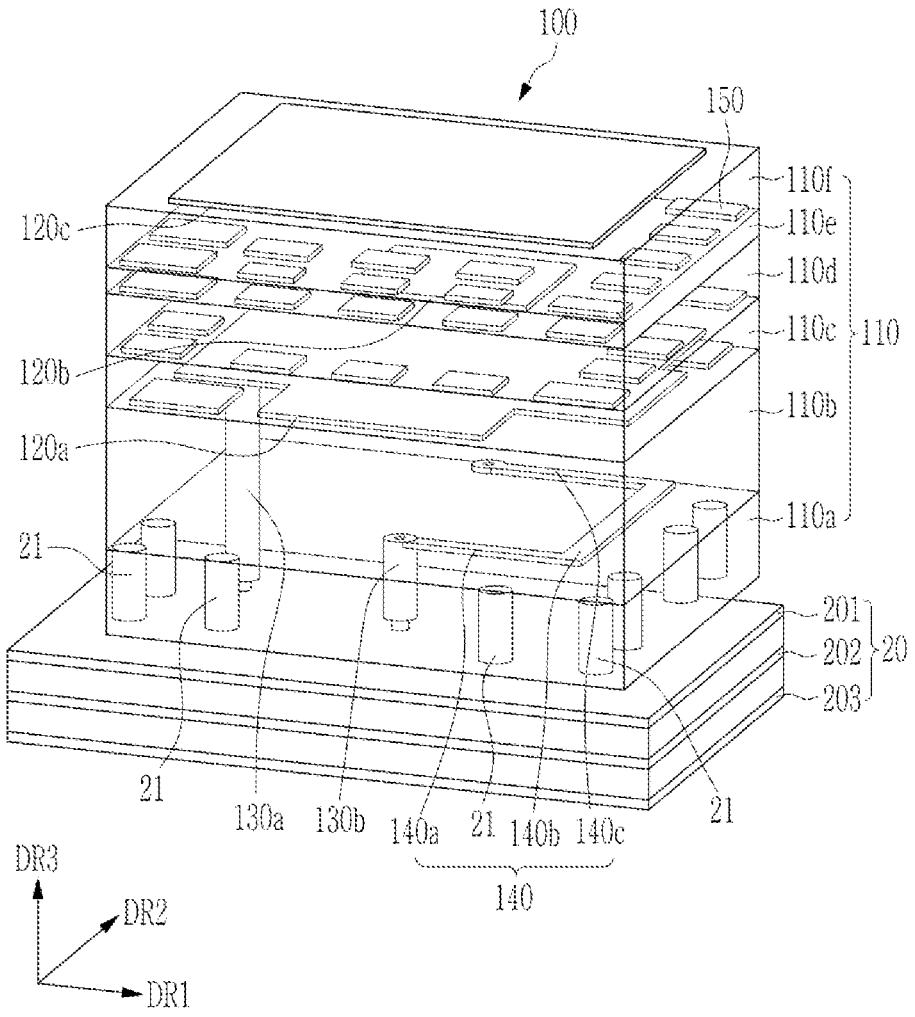
FIG. 5 illustrates a perspective view of an example antenna device, in accordance with one or more embodiments.

An example of a configuration of an antenna 100 of an antenna device 1000 according to an example will now be described with reference to FIG. 1, FIG. 2, FIG. 5, and FIG. 6. FIG. 5 illustrates a perspective view of an example antenna device according to an embodiment, and FIG. 6 illustrates a cross-sectional view of an example antenna device according to an embodiment.

Figure 6:
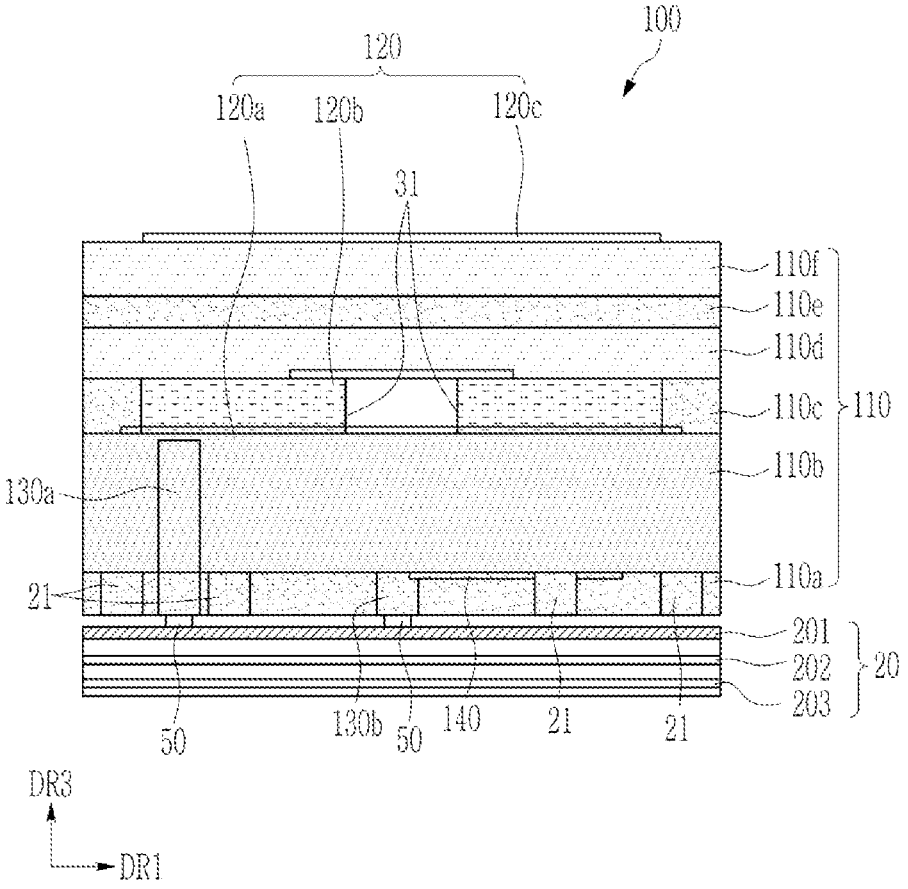
FIG. 6 illustrates a cross-sectional view of an example antenna device, in accordance with one or more embodiments.

Referring to FIG. 5 and FIG. 6, the antenna 100 of the antenna device 1000 according to an example includes: a dielectric layer 110 including a plurality of layers 110*a*, 110*b*, 110*c*, 110*d*, 110*e*, and 110*f*; an antenna patch 120 including a first sub-antenna patch 120*a*, a second sub-antenna patch 120*b*, and a third sub-antenna patch 120*c*; a first feed via 130*a*; a second feed via 130*b*; a feed pattern 140 connected to the second feed via 130*b*; and a plurality of shield vias 21 disposed around the first feed via 130*a* and the second feed via 130*b*.

A connection substrate 20 including a ground plane 201 and a plurality of metal layers 202 and 203 may be disposed below the antenna 100, and the antenna 100 may be connected to the connection substrate 20 through the connector 50. The first feed via 130*a* and the second feed via 130*b* of the antenna 100 may receive an electrical signal from an electronic element (not shown) disposed below the connection substrate 20.

The dielectric layer 110 may include a first layer 110*a*, a second layer 110*b*, a third layer 110*c*, a fourth layer 110*d*, a fifth layer 110*e*, and a sixth layer 110*f* sequentially disposed in the third direction DR3.

In an example, the first layer 110*a* to the sixth layer 110*f* may have different dielectric constants. In an example, the dielectric constants of the first layer 110*a*, the second layer 110*b*, the fourth layer 110*d*, and the sixth layer 110*f* may be greater than the dielectric constants of the third layer 110*c* and the fifth layer 110*e*. In an example, the first layer 110*a*, the second layer 110*b*, the fourth layer 110*d*, and the sixth layer 110*f* may include a ceramic-based material such as a low temperature co-fired ceramic (LTCC) or a material with a relatively high dielectric constant such as a glass-based material, and may further include at least one of magnesium (Mg), silicon (Si), aluminum (Al), calcium (Ca), and titanium (Ti). In an example, the third layer 110*c* and the fifth layer 110*e* may include a polymer, may include a highly flexible material such as a liquid crystal polymer (LCP) or a polyimide, may include an epoxy resin with high strength or adhesiveness, or may include a Teflon, and prepreg. The third layer 110*c* and the fifth layer 110*e* may have adherence.

The first layer 110*a* to the sixth layer 110*f* may have different thicknesses. In an example, the second layer 110*b* may be the thickest, and the fifth layer 110*e* may be the thinnest.

The third layer 110*c* may have an air cavity 11 disposed in a center thereof. The air cavity 31 may be filled with air, and accordingly, the dielectric constant of the third layer 110*c* may be reduced. A length of a boundary portion among the third layer 110*c*, the second layer 110*b*, and the fourth layer 110*d* with different dielectric constants may be further increased by the air cavity 31 of the third layer 110*c*. As described above, as the dielectric layer 110 includes a plurality of layers with different dielectric constants, and the second layer 110*a*2 with a relatively high dielectric constant includes an air cavity 31, a dielectric constant boundary side among the layers with different dielectric constants is generated, and the radiation pattern of the antenna may be changed by the dielectric constant boundary side. The dielectric constant boundary side in the dielectric layer 110 may be adjusted to change the radiation pattern of the antenna and accordingly increase the gain of the antenna.

The antenna patch 120 may include a first sub-antenna patch 120*a* disposed on the second layer 110*b* of the dielectric layer 110, a second sub-antenna patch 120*b* disposed on the third layer 110*c* of the dielectric layer 110, and a third sub-antenna patch 120*c* disposed on the sixth layer 110*f* of the dielectric layer 110. The first sub-antenna patch 120*a* may include a hole 121.

The first feed via 130*a* may penetrate through the first layer 110*a* and the second layer 110*b* in the third direction DR3, and the upper side of the first feed via 130*a* may be disposed in the hole 121 of the first sub-antenna patch 120*a* disposed on the second layer 110*b*.

The second feed via 130*b* penetrates through the first layer 110*a* in the third direction DR3 and is connected to the feed pattern 140 disposed on the first layer 110*a*. The feed pattern 140 includes a first portion 140*a* connected to the second feed via 130*b* and extending in a direction in parallel with the first direction DR1, a second portion 140*b* extending in a direction in parallel with the second direction DR2 from the first portion 140*a*, and a third portion 140*c* extending in a direction in parallel with the first direction DR1 from the second portion 140*b*. The second feed via 130*b* and the feed pattern 140 are disposed below the antenna patch 120.

The antenna 100 may transmit and receive the RF signal with first polarization through the electrical signal applied by the first feed via 130*a*, and may transmit and receive the RF signal with second polarization through the electrical signal applied by the second feed via 130*b*.

The first sub-antenna patch 120*a* is spaced apart from the first feed via 130*a* and the lateral side of the edge of the hole 121 of the antenna patch 120 to be coupled with the first feed via 130*a*, and thereby receive the electrical signal of the first feed via 130*a*. Further, the first sub-antenna patch 120*a* overlaps the feed pattern 140 extending from the second feed via 130*b* in the third direction DR3 to be coupled with the second feed via 130*b* and the feed pattern 140 and accordingly receive the electrical signal of the second feed via 130*b*.

The electrical signal transmitted through the first feed via 130*a* may be transmitted to the antenna patch 120 by the coupling of the first feed via 130*a* and the first sub-antenna patch 120*a* with the edge of the hole 121 of the first sub-antenna patch 120*a* as a path.

The electrical signal transmitted through the second feed via 130*b* is transmitted to the antenna patch 120 by the coupling between the feed pattern 140 overlapping the first sub-antenna patch 120*a* and the first sub-antenna patch 120*a*.

When the electrical signal is applied to the first feed via 130*a* and the second feed via 130*b*, the first sub-antenna patch 120*a* to the third sub-antenna patch 120*c* may transmit and receive the RF signal.

An area of the antenna patch of the antenna may influence a resonance frequency of the antenna, and the resonance frequency of the antenna including an antenna patch with a relatively narrow surface may be high. The surface of the second sub-antenna patch 120*b* may be smaller than the surface of the first sub-antenna patch 120*a*, and the second sub-antenna patch 120*b* may have a greater resonance frequency than the resonance frequency of the first sub-antenna patch 120*a*.

Further, the third sub-antenna patch 120*c* may be coupled with the second sub-antenna patch 120*b* to provide additional impedance to the second sub-antenna patch 120*b*, and widen the bandwidth of the antenna 100.

The antenna 100 may transmit and receive the RF signal with first polarization through the electrical signal applied through the first feed via 130*a*, and may transmit and receive the RF signal with second polarization through the electrical signal applied by the second feed via 130*b*. In an example, the RF signal with first polarization may have horizontal polarization, and the second polarization RF signal may have vertical polarization.

A first surface current flowing to the antenna patch 120 corresponding to the RF signal with first polarization transmitted through the first feed via 130*a*, and a second surface current flowing to the antenna patch 120 corresponding to the RF signal with second polarization through the second feed via 130*b*, may be orthogonal to each other on the antenna patch 120. Accordingly, an electric field and a magnetic field corresponding to the RF signal with first polarization may be orthogonal to an electric field and a magnetic field corresponding to the RF signal with second polarization, and the RF signal with first polarization and the RF signal with second polarization may form a polarized wave.

The antenna 100 may receive the electrical signal for transmitting and receiving the RF signal with first polarization through the first feed via 130*a* inserted into the hole 121 of the antenna patch 120 and coupled with the antenna patch 120, and receive the electrical signal for transmitting and receiving the RF signal with second polarization through the second feed via 130*b* and the feed pattern 140 disposed below the antenna patch 120 and overlapping the antenna patch 120 and the feed pattern 140 to be coupled with the antenna patch 120. Therefore, the electrical signal for transmitting and receiving the RF signal with second polarization of the antenna 100 of which the dielectric layer 110 is propagated in a direction with a relatively short fourth length Ly1 may be transmitted by the feed pattern 140 connected to the second feed via 130*b*, and the antenna 100 may receive an additional resonance frequency corresponding to the inductance of the feed pattern 140 overlapping the antenna patch 120, thereby preventing the bandwidth of the RF signal with second polarization from being reduced.

Further, the second feed via 130*b* and the feed pattern 140 may be lower than the first feed via 130*a*, and accordingly, the isolation degree among the first feed via 130*a*, the second feed via 130*b*, and the feed pattern 140 may be increased.

The antenna 100 may be disposed on the second layer 110*b*, the third layer 110*c*, the fourth layer 110*d*, and the fifth layer 110*e* of the dielectric layer 110, and a plurality of dummy patterns 150 fill a space between the antenna patch 120 and the dielectric layer 110 so that the antenna patch 120 may be well maintained on the dielectric layer 110 without a change of forms. A plurality of shield vias 21 disposed around the first feed via 130*a* and the second feed via 130*b* may support a current transmitted through the first feed via 130*a* and the second feed via 130*b* so that the current may not be lost through a peripheral dielectric layer but may be fed to the antenna patch 120.

Figure 7:
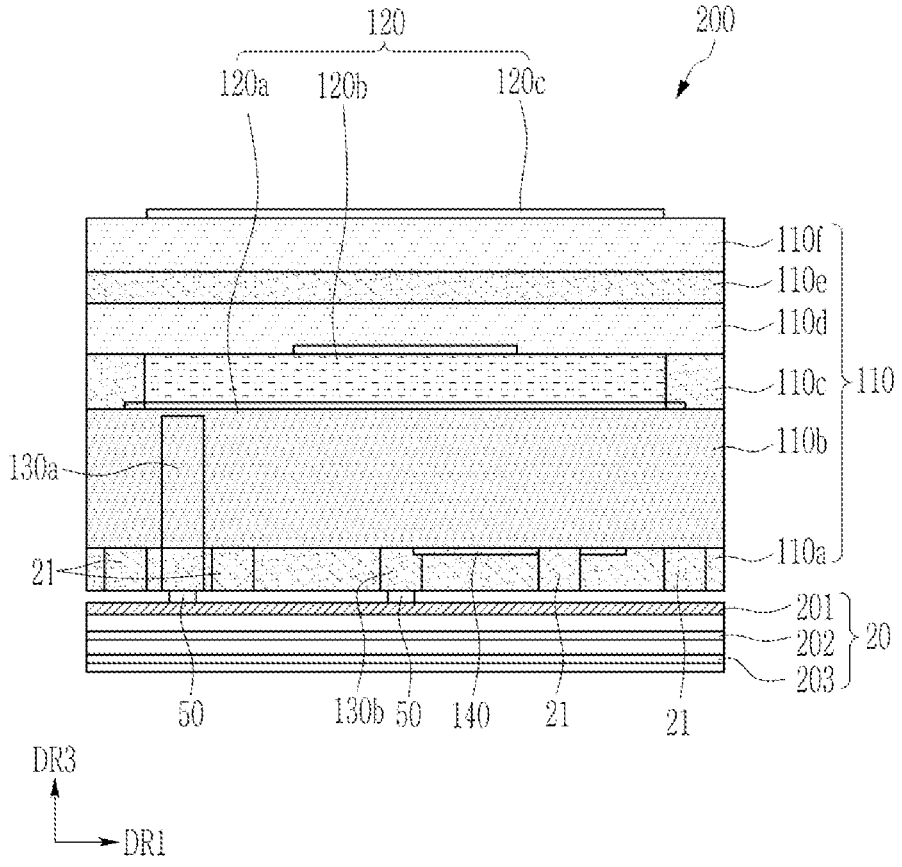
FIG. 7 illustrates a cross-sectional view of an example antenna, in accordance with one or more embodiments.

An antenna 200 according to another example will now be described with reference to FIG. 5 and FIG. 7. FIG. 7 illustrates a cross-sectional view of an antenna, in accordance with one or more embodiments.

Referring to FIG. 7, the antenna 200 according to the present example is similar to the antenna 100 according to an example described with reference to FIG. 6. No detailed descriptions of the same constituent elements will be provided.

The antenna 200 includes: a dielectric layer 110 including a plurality of layers 110*a*, 110*b*, 110*c*, 110*d*, 110*e*, and 110*f*; an antenna patch 120 including a first sub-antenna patch 120*a*, a second sub-antenna patch 120*b*, and a third sub-antenna patch 120*c*; a first feed via 130*a*; a second feed via 130*b*; a feed pattern 140 connected to the second feed via 130*b*; and a plurality of shield vias 21 disposed around the first feed via 130*a* and the second feed via 130*b*.

A connection substrate 20 including a ground plane 201 and a plurality of metal layers 202 and 203 may be disposed below the antenna 200, and the antenna 200 may receive an electrical signal from an electronic element (not shown) disposed below the connection substrate 20.

However, regarding the antenna 200 according to the present example, differing from the antenna 100 according to an example described with reference to FIG. 6, an air cavity 31 may not be provided in the third layer 110*c* of the dielectric layer 110. The method for manufacturing the antenna 100*a* may be simplified by not forming an air cavity 31 in the third layer 110*c* as described above, thereby reducing the manufacturing cost.

In a similar manner as described with reference to FIG. 1 and FIG. 2, FIG. 3 and FIG. 4, and FIG. 5 and FIG. 6, the antenna 200 may receive the electrical signal for transmitting and receiving the RF signal with first polarization through the first feed via 130*a* inserted in the hole 121 of the antenna patch 120 and coupled with the antenna patch 120, and receive the electrical signal for transmitting and receiving the RF signal with second polarization through the second feed via 130*b* and the feed pattern 140 disposed below the antenna patch 120 and overlapping the antenna patch 120 to be coupled with the antenna patch 120. Therefore, the electrical signal for transmitting and receiving the RF signal with second polarization of the antenna 100 of which the dielectric layer 110 is propagated in a direction with a relatively short fourth length Ly1 may be transmitted by the feed pattern 140 connected to the second feed via 130*b*, and the antenna 100 may receive an additional resonance frequency corresponding to the inductance of the feed pattern 140 overlapping the antenna patch 120, thereby preventing the bandwidth of the RF signal with second polarization from being reduced.

Additionally, the second feed via 130*b* and the feed pattern 140 may be lower than the first feed via 130*a*, and accordingly, the isolation degree among the first feed via 130*a*, the second feed via 130*b*, and the feed pattern 140 may be increased.

Figure 8:
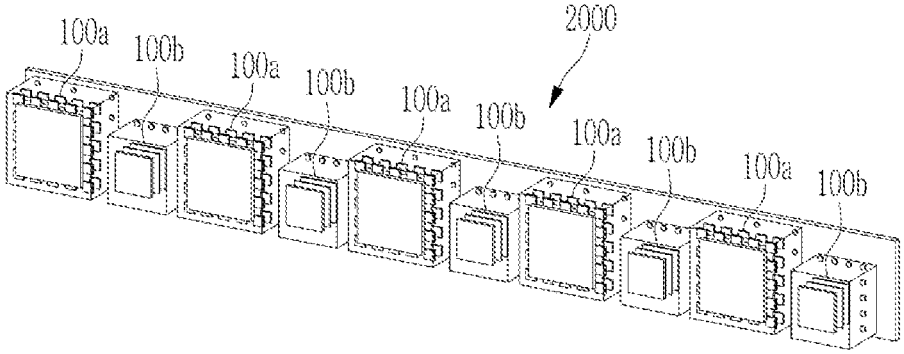
FIG. 8 illustrates a perspective view of an example antenna device, in accordance with one or more embodiments.

An example antenna device 2000, in accordance with one or more embodiments, will now be described with reference to FIG. 8 and FIG. 9. FIG. 8 illustrates a perspective view of an example antenna device, in accordance with one or more embodiments, and FIG. 9 illustrates a top plan view of an example antenna device, in accordance with one or more embodiments.

Figure 9:
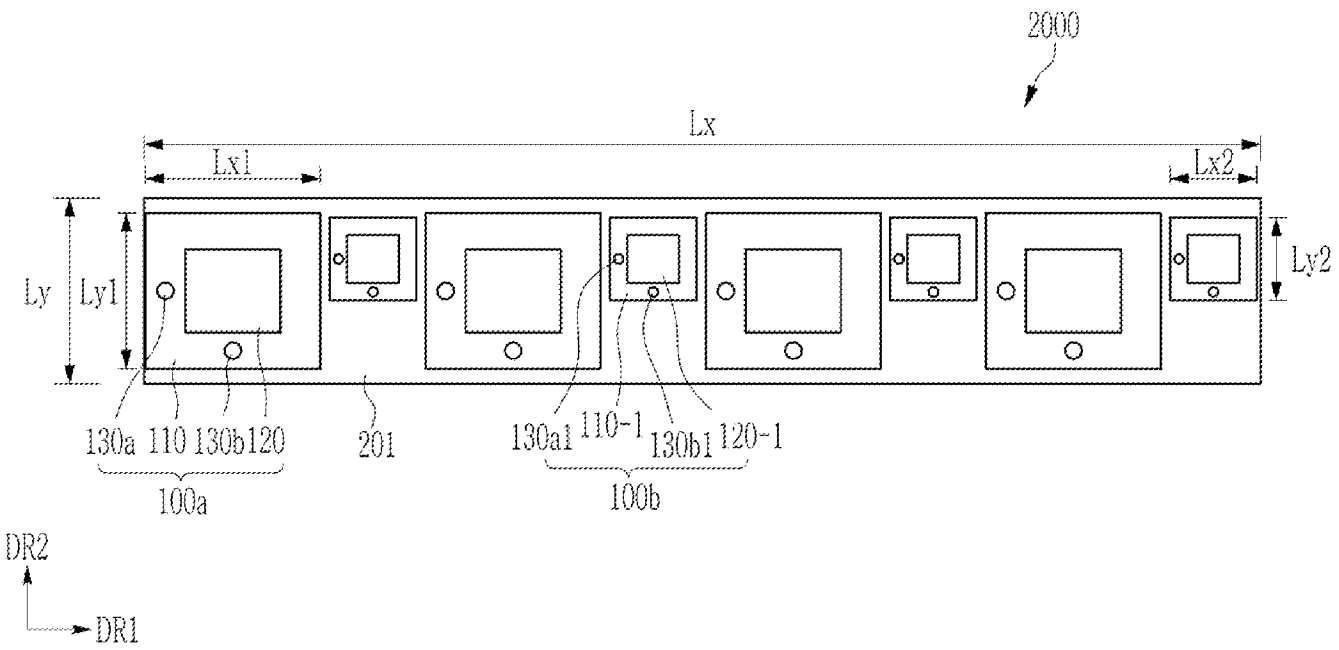
FIG. 9 illustrates a top plan view of an example antenna device, in accordance with one or more embodiments.

Referring to FIG. 8 and FIG. 9, the example antenna device 2000, in accordance with one or more embodiments, includes a plurality of first antennae 100*a* and a plurality of second antennae 100*b*. The first antennae 100*a* and the second antennae 100*b* may be configured in pairs, and may be disposed in the first direction DR1 in pairs.

The first antenna 100*a* may transmit and receive the RF signal with a first bandwidth, and the second antenna 100*b* may transmit and receive the RF signal with a second bandwidth that is different from the first bandwidth. The center frequency of the first bandwidth may be lower than the center frequency of the second bandwidth. In an example, the center frequency of the first bandwidth of the first antenna 100*a* may be, as a non-limiting example, approximately 24 GHz or approximately 28 GHz, and the center frequency of the second bandwidth of the second antenna 100*b* may be approximately 39 GHz.

The antenna device 2000 may have a first length (Lx) in parallel with the first direction DR1, and a second length (Ly) in parallel with the second direction DR2 that is perpendicular to the first direction DR1, and the first length (Lx) may be greater than the second length (Ly).

The dielectric layer 110 of the first antenna 100*a* of the antenna device 2000 may have a third length Lx1 in parallel with the first direction DR1, and a fourth length Ly1 in parallel with the second direction DR2. The fourth length Ly1 may be less than the third length Lx1.

The dielectric layer 110-1 of the second antenna 100*b* of the antenna device 2000 may have a fifth length Lx2 in parallel with the first direction DR1, and a sixth length Ly2 in parallel with the second direction DR2. The fifth length Lx2 may be substantially equivalent to the sixth length Ly2.

The antenna device 2000 may be mounted on the electronic device, the size of the bezel of the electronic device may be reduced, and the antenna device 2000 may be mounted on the lateral side of the bezel, and may not be mounted on the front side of the electronic device. Since the form factor of the electronic device is reduced, the lateral side of the bezel on which the antenna device 2000 is mounted is also reduced, and the second length (Ly) of the antenna device 2000 is accordingly reduced. The fourth length Ly1 of the first antenna 100*a* included in the antenna device 2000 is also reduced. However, the sixth length Ly2 of the second antenna 100*b* included in the antenna device 2000 may be less than the second length (Ly), accordingly it may be made substantially equivalent to the fifth length Lx2.

Figure 10:
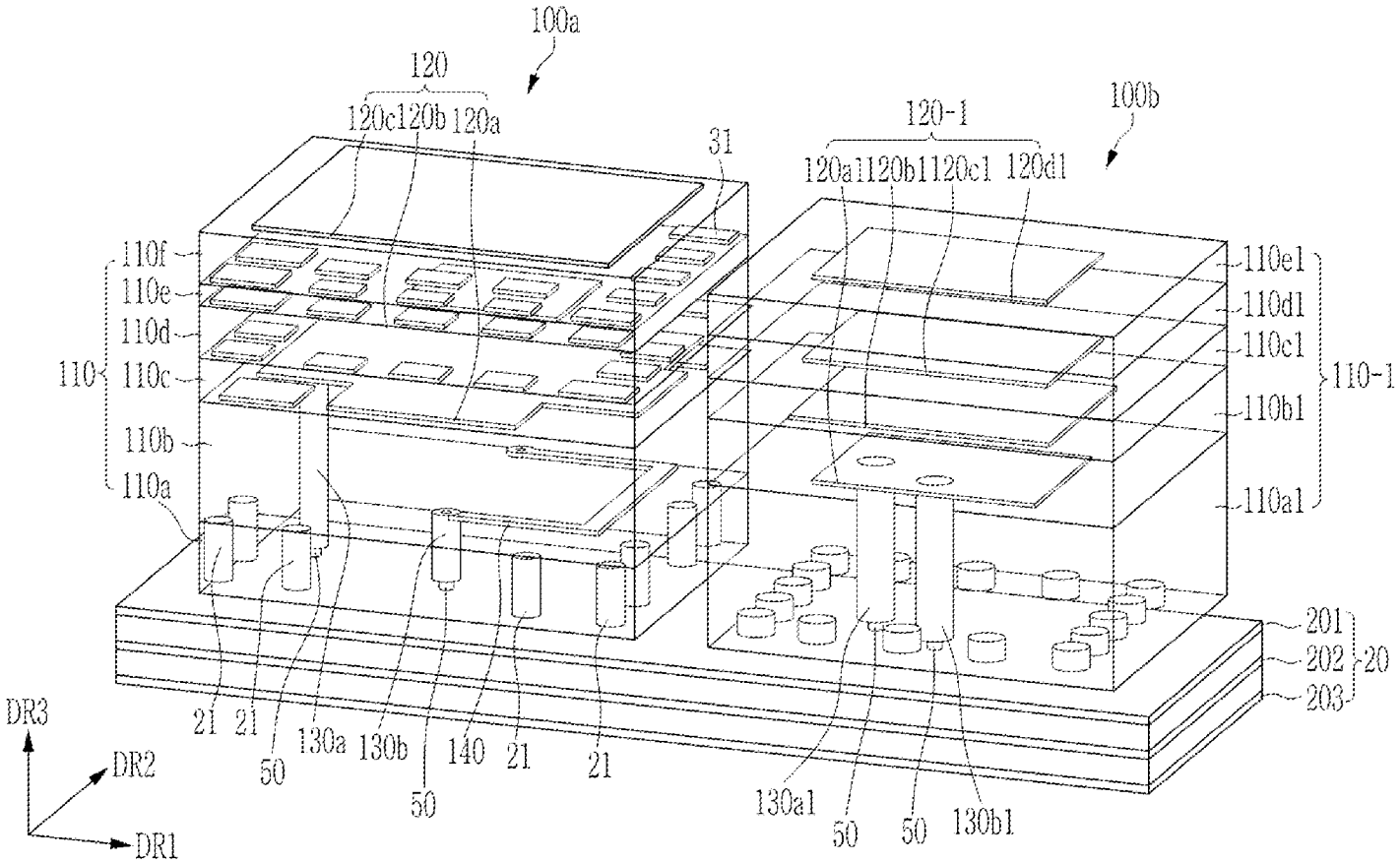
FIG. 10 illustrates a perspective view of an example antenna device, in accordance with one or more embodiments.

A configuration of a first antenna 100*a* and a second antenna 100*b* of an example antenna device 2000, in accordance with one or more embodiments, described with reference to FIG. 8 and FIG. 9 will now be described with reference to FIG. 10. FIG. 10 illustrate a perspective view of an example antenna device, in accordance with one or more embodiments.

Referring to FIG. 10, the configuration of the first antenna 100*a* of the antenna device 2000 is similar to the above-described antennas 100 and 200 according to examples.

The first antenna 100*a* includes: a dielectric layer 110 including a plurality of layers 110*a*, 110*b*, 110*c*, 110*d*, 110*e*, and 110*f*; an antenna patch 120 including a first sub-antenna patch 120*a*, a second sub-antenna patch 120*b*, and a third sub-antenna patch 120*c*; a first feed via 130*a*; a second feed via 130*b*; a feed pattern 140 connected to the second feed via 130*b*; and a plurality of shield vias 21 disposed around the first feed via 130*a* and the second feed via 130*b*.

The second antenna 100*b* includes: a first dielectric layer 110-1 including a plurality of layers 110*a*1, 110*b*1, 110*c*1, 110*d*1, and 110*e*1; a first antenna patch 120-1 including a fourth sub-antenna patch 120*a*1, a fifth sub-antenna patch 120*b*1, a sixth sub-antenna patch 120*c*1, and a seventh sub-antenna patch 120*d*1; a third feed via 130*a*1; a fourth feed via 130*b*1; and a plurality of first shield vias 21-1 disposed around the third feed via 130*a*1 and the fourth feed via 130*b*1.

The plurality of layers 110*a*1, 110*b*1, 110*c*1, 110*d*1, and 110*e*1 of the first dielectric layer 110-1 may have different dielectric constants and layer thicknesses. In addition, the layers with small dielectric constants from among the layers 110*a*1, 110*b*1, 110*c*1, 110*d*1, and 110*e*1 of the first dielectric layer 110-1 may have adherence.

The first antenna patch 120-1 includes the fourth sub-antenna patch 120*a*1, the fifth sub-antenna patch 120*b*1, the sixth sub-antenna patch 120*c*1, and the seventh sub-antenna patch 120*d*1, so the first antenna patch 120-1 may increase the bandwidth and the gain of the second antenna 100*b* according to the resonance among the fourth sub-antenna patch 120*a*1, the fifth sub-antenna patch 120*b*1, the sixth sub-antenna patch 120*c*1, the seventh sub-antenna patch 120*d*1, and the ground plane 201, and the coupling among the fourth sub-antenna patch 120*a*1, the fifth sub-antenna patch 120*b*1, the sixth sub-antenna patch 120*c*1, and the seventh sub-antenna patch 120*d*1.

The example antenna device 2000, in accordance with one or more embodiments, includes the first antenna 100*a* that transmits and receives the RF signal with a first bandwidth with a relatively low center frequency, and a second antenna 100*b* that transmits and receives the RF signal with a second bandwidth having a relatively high center frequency, thereby transmitting and receiving the multi-band RF signal.

Additionally, in a similar manner of the examples described with reference to FIG. 1 and FIG. 2, FIG. 3 and FIG. 4, and FIG. 5 and FIG. 6, the first antenna 100*a* of the antenna device 2000 receives the electrical signal for transmitting and receiving the RF signal with first polarization through the first feed via 130*a* inserted into the hole 121 of the antenna patch 120 of the first antenna 100*a* and coupled with the antenna patch 120, and the first antenna 100*a* of the antenna device 2000 receives the electrical signal for transmitting and receiving the RF signal with second polarization through the second feed via 130*b* and the feed pattern 140 disposed below the antenna patch 120 and overlapping the antenna patch 120 to be coupled with the antenna patch 120. Therefore, the first antenna 100*a* that transmits and receives the RF signal with a first bandwidth, receives the electrical signal for transmitting and receiving the RF signal with second polarization which is propagated in a direction with a relatively short fourth length Ly1 of the dielectric layer 110 by the feed pattern 140 connected to the second feed via 130*b*, and the first antenna 100*a* may receive an additional resonance frequency corresponding to the inductance of the feed pattern 140 overlapping the antenna patch 120, thereby preventing the bandwidth of the RF signal with second polarization from being reduced.

On the contrary, the second antenna 100*b* that transmits and receives the RF signal with a second bandwidth, may receive the electrical signal, for transmitting and receiving the RF signal with first polarization through the third feed via 130*a*1 and the electrical signal for transmitting and receiving the RF signal with second polarization through the fourth feed via 130*b*1 according to the same method.

Many characteristics of the antenna and the antenna devices according to the above-described embodiments are applicable to the antenna and the antenna device according to the present embodiment.

Figure 11:
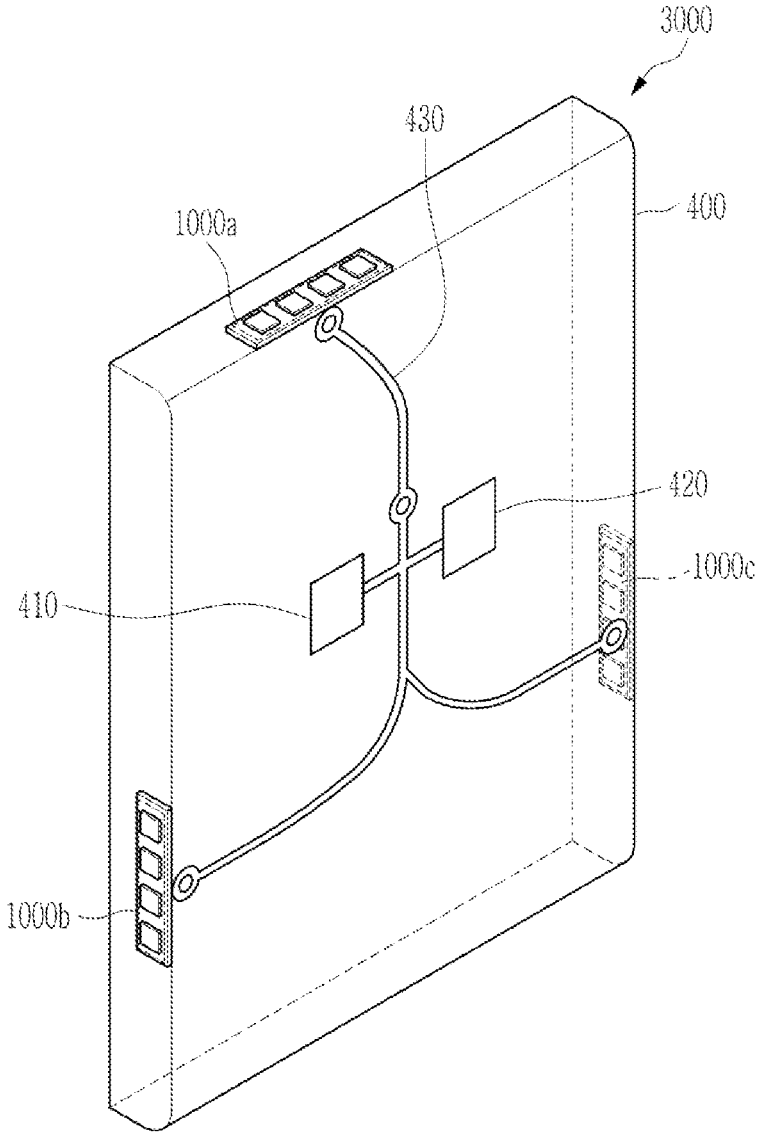
FIG. 11 illustrates an example electronic device including an example antenna device, in accordance with one or more embodiments.

An electronic device 3000 including an example antenna device, in accordance with one or more embodiments, will now be described with reference to FIG. 11. FIG. 11 illustrates an example electronic device including an antenna device, in accordance with one or more embodiments.

Referring to FIG. 11, the electronic device 3000 includes antenna devices 1000*a*, 1000*b*, and 1000*c*, and the antenna devices 1000*a*, 1000*b*, and 1000*c* may be disposed on a lateral side of the body 400 of the electronic device 3000.

The electronic device 3000 may be, as non-limiting examples, a smart phone, a personal digital assistant, a digital video camera, a digital still camera, a network system, a computer, a monitor, a tablet, a laptop, a netbook, a television, a video game, a smart watch, and an automotive part, and is not limited thereto.

The electronic device 3000 may have a plurality of sides, and the antenna devices 1000*a*, 1000*b*, and 1000*c* may be disposed to be adjacent to at least part of a plurality of sides of the electronic device 3000.

A communication module 410 and a baseband circuit 420 may be disposed on the body 400, and the antenna device 3000 may be electrically connected the communication module 410 and the baseband circuit 420 through a coaxial cable 430.

To perform digital signal processing, the communication module 410 may include at least one of memory chips such as a volatile memory (e.g., a DRAM), a non-volatile memory (e.g., a ROM), or a flash memory, application processor chips such as a central processing unit (CPU), a graphics processing unit (GPU), a digital signal processor, an encoding processor, a microprocessor, or a microcontroller, and logic chips such as an analog-digital converter or an application-specific IC (ASIC).

The baseband circuit 420 may generate a base signal by performing analog to digital conversion, amplifying an analog signal, performing filtering, and performing frequency conversion. The base signal input/output from the baseband circuit 420 may be transmitted to the antenna device through a cable. In an example, the base signal may be transmitted to the IC through an electrical connection structure, a core via, and a wire, and the IC may convert the base signal to the RF signal in the millimeter wave (mmWave) bandwidth.

Although not shown, the respective antenna devices 1000*a*, 1000*b*, and 1000*c* may include a plurality of antennae, and the respective antenna devices 1000*a*, 1000*b*, and 1000*c* may be similar to the antenna devices 1000 and 2000 according to the above-described examples.

Figure 12A:
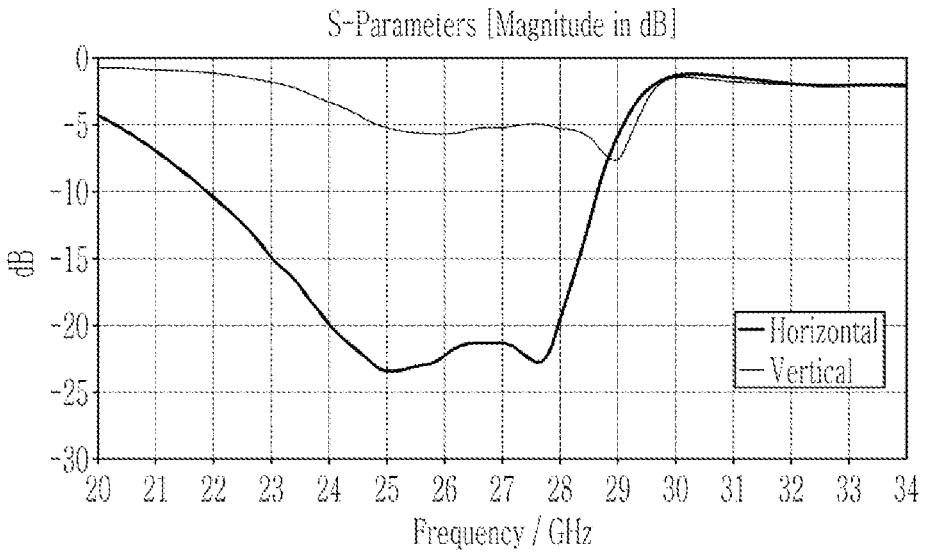
FIG. 12A and FIG. 12B illustrate graphs of results of an experimental example.
Figure 12B:
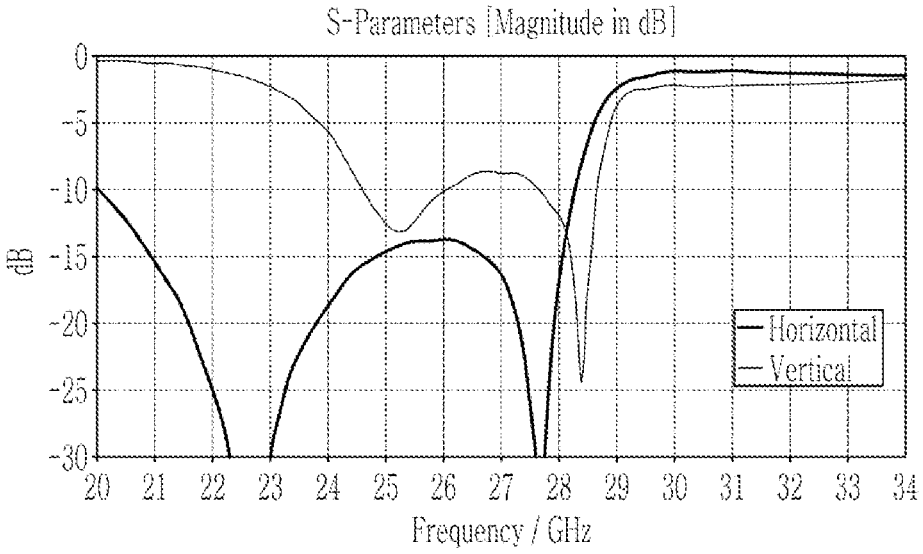

An experimental example will now be described with reference to FIG. 12A and FIG. 12B. FIG. 12A and FIG. 12B illustrate graphs of results of an experimental example.

In the present experimental example, as shown in FIG. 1, an antenna with a dielectric layer having a third length Lx1 in a direction that is parallel to the first direction DR1 and a fourth length Ly1 in a direction that is parallel to the second direction DR2 is formed, and here, the fourth length Ly1 is less than the third length Lx1.

Other conditions are given in a same way, and the antenna device is manufactured according to a first example (Example 1) in which the first feed via 130*a* and the second feed via 130*b* apply the electrical signal to the antenna patch according to the same feeding method by allowing the upper side of the second feed via 130*b* to be inserted into the hole formed in the antenna patch in a like manner of the first feed via 130*a*, and a second example (Example 2) in which the first feed via 130*a* and the second feed via 130*b* apply the electrical signal to the antenna patch according to different feeding methods by inserting the upper side of the first feed via 130*a* into the hole formed in the antenna patch, allowing the second feed via 130*b* to be lower than the first feed via 130*a*, and allowing the feed pattern 140 connected to the second feed via 130*b* to overlap the first sub-antenna patch 120*a* in a like manner of the antenna device according to an example.

Regarding the first example (Example 1) and the second example (Example 2) after manufacturing the antenna device, S-parameters of the RF signal with first polarization that is horizontal polarization caused by feeding through the first feed via 130*a* and the RF signal with second polarization that is vertical polarization caused by feeding through the second feed via 130*b* and the feed pattern 140 are measured, and the results are shown in FIG. 12A and FIG. 12B. FIG. 12A shows the result of the first example (Example 1), and FIG. 12B shows the result of the second example (Example 2).

Referring to FIG. 12A, regarding the first feed via 130*a* and the second feed via 130*b*, in the first example (Example 1) in which the electrical signal is applied to the antenna patch according to the same feeding method, a return loss with horizontal polarization is −10 dB and has the bandwidth of 6.8 GHz, but the return loss with vertical polarization is around 5 dB, showing degraded antenna performance.

On the contrary, referring to FIG. 12B, in the second example (Example 2) in which the first feed via 130*a* and the second feed via 130*b* apply the electrical signal to the antenna patch with different feeding methods in a similar manner of the antenna device according to an example, the antenna performance may be excellent so that the example of vertical polarization may have the bandwidth of 5 GHz in a similar manner to the horizontal polarization.

As described, in a similar manner of the antenna device according to an example, the upper side of the first feed via 130*a* is inserted into the hole formed in the antenna patch, the second feed via 130*b* is lower than the first feed via 130*a*, the feed pattern 140 connected to the second feed via 130*b* overlaps the first sub-antenna patch 120*a*, so the first feed via 130*a* and the second feed via 130*b* apply the electrical signals to the antenna patch according to different feeding methods, and it is accordingly found that the example of vertical polarization has excellent antenna performance in a similar manner to the horizontal polarization.

Figure 13A:
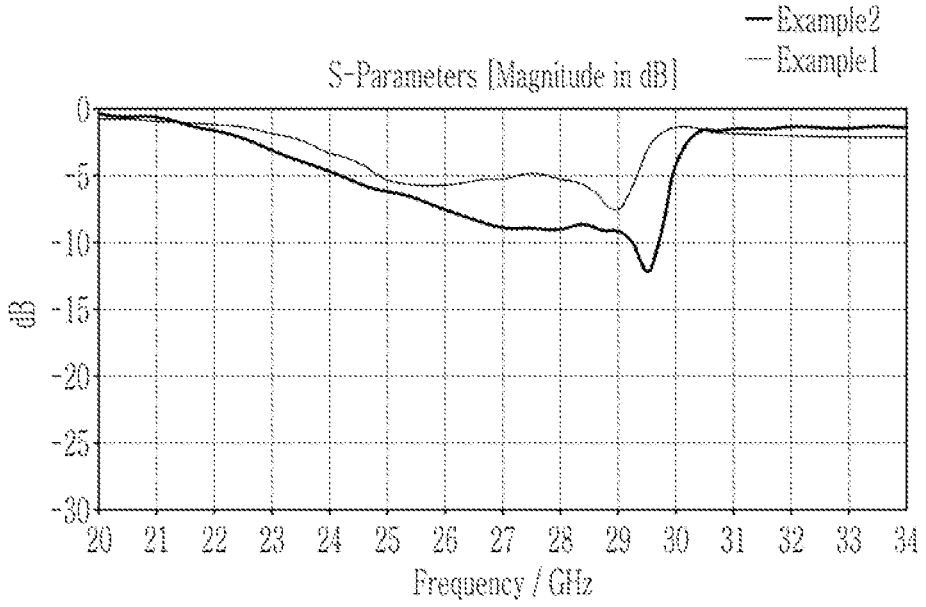
FIG. 13A and FIG. 13B illustrate graphs of results of an experimental example.
Figure 13B:
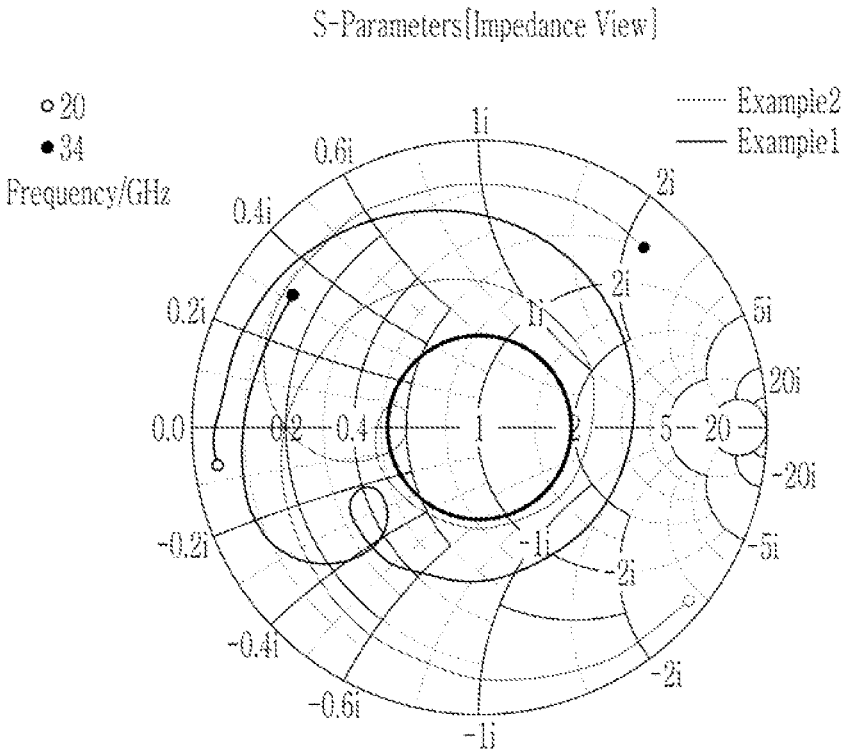

Another experimental example will now be described with reference to FIG. 13A and FIG. 13B. FIG. 13A and FIG. 13B show graphs of results of an experimental example.

In the present experimental example, as shown in FIG. 1, an antenna includes a dielectric layer having a third length Lx1 in a direction parallel to the first direction DR1 and a fourth length Ly1 in a direction parallel to the second direction DR2, where the fourth length Ly1 is less than the third length Lx1.

Other conditions are given in a same way, and the antenna device is manufactured according to a first example (Example 1) in which the first feed via 130*a* and the second feed via 130*b* apply the electrical signal to the antenna patch according to the same feeding method by allowing the upper side of the second feed via 130*b* to be inserted into the hole formed in the antenna patch in a like manner of the first feed via 130*a*, and a second example (Example 2) in which the first feed via 130*a* and the second feed via 130*b* apply the electrical signal to the antenna patch according to different feeding methods by inserting the upper side of the first feed via 130*a* into the hole formed in the antenna patch, allowing the second feed via 130*b* to be lower than the first feed via 130*a*, and allowing the feed pattern 140 connected to the second feed via 130*b* to overlap the first sub-antenna patch 120*a* in a like manner of the antenna device according to an example.

Regarding the first example (Example 1) and the second example (Example 2) after manufacturing the antenna device, the S-parameters of the RF signal with second polarization that is vertical polarization caused by the feeding through the second feed via 130*b* and the feed pattern 140 are measured, and the results are shown in FIG. 13A and FIG. 13B.

Referring to FIG. 13A, compared to the first example (Example 1), it is found in the second example (Example 2)

according to an example that the antenna performance with vertical polarization is relatively excellent.

Referring to FIG. 13B, compared to the first example (Example 1), it is found in the second example (Example 2) according to an example that a radiation range of the vertical polarization is wider, and by this, the antenna performance is relatively excellent.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna device, comprising:

a dielectric layer, comprising a first edge that extends in a first direction, and a second edge that extends in a second direction;

a first feed via, configured to penetrate through at least a portion of the dielectric layer in a third direction, and disposed to be adjacent to the second edge;

a second feed via, configured to penetrate through at least a portion of the dielectric layer in the third direction, and disposed to be adjacent to the first edge;

a feed pattern, connected to the second feed via; and an antenna patch, disposed on the second feed via and the feed pattern in the third direction, and coupled to the first feed via, the second feed via, and the feed pattern, wherein the first edge is longer than the second edge, wherein the first feed via is implemented without a feed pattern, and wherein the antenna patch overlaps the first feed via without a feed pattern in a direction parallel to the first direction or the second direction, and the antenna patch overlaps the feed pattern in a direction parallel to the third direction.

2. The antenna device of claim 1, further comprising:

a ground plane, disposed below the dielectric layer in the third direction, wherein a height of the first feed via is greater than a height of the second feed via and a height of the feed pattern with respect to the ground plane in the third direction.

3. The antenna device of claim 2, wherein:

the antenna patch is configured to have at least one hole, and the first feed via overlaps the antenna patch in the direction parallel to the first direction or the second direction in the at least one hole.

4. The antenna device of claim 3, wherein:

the feed pattern comprises a first portion connected to the second feed via and extending in a direction parallel to the first direction, and a second portion that extends from the first portion in a direction parallel to the second direction.

5. The antenna device of claim 1, wherein:

the antenna device is configured to transmit and receive a horizontal polarization signal based on an electrical signal applied to the first feed via, and is configured to transmit and receive a vertical polarization signal based on an electrical signal applied to the second feed via.

6. The antenna device of claim 1, wherein:

the antenna patch comprises a first antenna patch and a second antenna patch sequentially disposed in the third direction, and a surface area of the second antenna patch is greater than a surface area of the first antenna patch.

7. The antenna device of claim 6, wherein:

the dielectric layer comprises a first layer, a second layer, a third layer, and a fourth layer sequentially disposed in the third direction, the first feed via penetrates through the first layer and the second layer, and the second feed via penetrates through the first layer, and the feed pattern is disposed on the first layer.

8. The antenna device of claim 7, wherein:

the first antenna patch is disposed on the second layer, the third layer is disposed between the first antenna patch and the second antenna patch, a dielectric constant of the third layer is smaller than a dielectric constant of the first layer and a dielectric constant of the second layer, and the third layer includes an air cavity.

9. An antenna device, comprising:

a first dielectric layer and a second dielectric layer spaced apart from each other in a first direction, the first dielectric layer having a first edge that extends in the first direction, and a second edge that extends in a second direction and the first edge being longer than the second edge;

a first antenna patch, disposed on the first dielectric layer in a third direction;

a second antenna patch, disposed on the second dielectric layer in the third direction;

a first feed via disposed to be adjacent to the second edge and coupled to the first antenna patch without a feed pattern;

a second feed via disposed to be adjacent to the first edge and coupled to the first antenna patch through a feed pattern extended from the second feed via; and a third feed via and a fourth feed via coupled to the second antenna patch, wherein the antenna device is configured to transmit and receive a signal with a first frequency bandwidth based on an electrical signal applied to the first antenna patch, and wherein the antenna device is configured to transmit and receive a signal with a second frequency bandwidth different from the first frequency bandwidth based on an electrical signal applied to the second antenna patch.

10. The antenna device of claim 9, wherein:

the first dielectric layer comprises a first edge that extends in the first direction and a second edge that extends in the second direction, the second dielectric layer comprises a third edge that extends in the first direction and a fourth edge that extends in the second direction, and the first edge is longer than the second edge.

11. The antenna device of claim 10, wherein:

a center frequency of the first frequency bandwidth is lower than a center frequency of the second frequency bandwidth.

12. The antenna device of claim 10, wherein:

the second feed via is disposed to be adjacent to the first edge, and the fourth feed via is disposed to be adjacent to the third edge.

13. The antenna device of claim 10, wherein:

the first feed via is disposed to be adjacent to the second edge, the first antenna patch includes at least one hole, and the first feed via overlaps the first antenna patch in a direction parallel to the first direction or the second direction in the at least one hole.

14. The antenna device of claim 13, wherein:

the feed pattern comprises a first portion connected to the second feed via and extending in a direction parallel to the first direction, and a second portion that extends from the first portion in a direction parallel to the second direction.

15. The antenna device of claim 9, wherein:

the antenna device is configured to transmit and receive a horizontal polarization signal based on an electrical signal applied to the first feed via, and is configured to transmit and receive a vertical polarization signal based on an electrical signal applied to the second feed via.

16. An antenna device, comprising:

a first dielectric layer and a second dielectric layer spaced apart from each other in a first direction, the first dielectric layer having a first edge that extends in the first direction, and a second edge that extends in a second direction and the first edge being longer than the second edge;

a first antenna patch, disposed on the first dielectric layer in a third direction;

a second antenna patch, disposed on the second dielectric layer in the third direction;

a first feed via and a second feed via coupled to the first antenna patch, the first feed via disposed to be adjacent to the second edge and the second feed via disposed to be adjacent to the first; and a third feed via and a fourth feed via coupled to the second antenna patch, wherein the antenna device is configured to transmit and receive a signal with a first frequency bandwidth based on an electrical signal applied to the first antenna patch, wherein the antenna device is configured to transmit and receive a signal with a second frequency bandwidth that is different from the first frequency bandwidth based on an electrical signal applied to the second antenna patch, wherein the first antenna patch is fed from the first feed via by a first feeding method, and is fed from the second feed via by a second feeding method that is different from the first feeding method, and wherein the second antenna patch is fed from the third feed via by a third feeding method, and is fed from the fourth feed via by the third feeding method.

17. The antenna device of claim 16, wherein:

a center frequency of the first frequency bandwidth is lower than a center frequency of the second frequency bandwidth.

18. The antenna device of claim 17, wherein:

the first feeding method is a capacitively coupled feeding method, and the second feeding method is an L-probe coupled feeding method.

19. The antenna device of claim 16, wherein:

the first dielectric layer comprises a first edge that extends in the first direction, and a second edge that extends in a second direction, the second dielectric layer comprises a third edge that extends in the first direction, and a fourth edge that extends in the second direction, and the first edge is longer than the second edge.

20. The antenna device of claim 19, wherein:

the first feed via is disposed to be adjacent to the second edge, the second feed via is disposed to be adjacent to the first edge, the third feed via is disposed to be adjacent to the fourth edge, the fourth feed via is disposed to be adjacent to the third edge, the first antenna patch includes at least one hole, and the first feed via overlaps the first antenna patch in a direction parallel to the first direction or the second direction in the at least one hole, and the antenna device further comprises a feed pattern comprising a first portion connected to the second feed via, and extending in a direction parallel to the first direction, and a second portion extending from the first portion in a direction parallel to the second direction.

* * * * *